United States Patent [19]

Falkowski et al.

[11] 4,152,179

[45] * May 1, 1979

[54] PROCESS FOR PRODUCING PHOSPHOROUS-BEARING SOFT MAGNETIC MATERIAL

[75] Inventors: Edward C. Falkowski, Pittsburgh; Carl E. Ruppel, Bridgeville, both of Pa.

[73] Assignee: Allegheny Ludlum Industries, Inc., Pittsburgh, Pa.

[ * ] Notice: The portion of the term of this patent subsequent to Sep. 13, 1994, has been disclaimed.

[21] Appl. No.: 810,132

[22] Filed: Jun. 27, 1977

Related U.S. Application Data

[60] Division of Ser. No. 571,169, Apr. 24, 1975, Pat. No. 4,047,983, which is a continuation-in-part of Ser. No. 417,682, Nov. 20, 1973, abandoned, which is a continuation of Ser. No. 238,516, Mar. 27, 1972, abandoned.

[51] Int. Cl.[2] ..... H01F 1/22

[52] U.S. Cl. ..... 148/105; 75/123 D; 75/211; 75/214; 75/224; 252/62.55

[58] Field of Search ..... 148/105, 108, 31.55, 148/103; 75/200, 211, 214, 224; 75/123 D, 0.5 BA; 252/62.55

[56] References Cited

U.S. PATENT DOCUMENTS

| | | | |
|---|---|---|---|
| 2,661,282 | 12/1953 | Dacey | 75/123 D |
| 3,120,698 | 2/1964 | Elliott | 148/105 |
| 3,497,347 | 2/1970 | Dautzenberg et al. | 75/0.5 BA |
| 3,836,355 | 9/1974 | Lindskog et al. | 75/0.5 BA |
| 4,047,983 | 9/1977 | Falkowski et al. | 148/105 |

OTHER PUBLICATIONS

Panasyuk, et al.; Effect of P-Additions on Mag. Prop. . . . Iron Powder, Jun. 1973, New York, (Plenum), pp. 289-292, 196-198 & 983-984.

Bozorth, R.; Ferromagnetism, New York, 1951, pp. 251-253.

*Primary Examiner*—R. Dean

*Assistant Examiner*—John P. Sheehan

*Attorney, Agent, or Firm*—Vincent G. Gioia; Robert F. Dropkin

[57] ABSTRACT

A method for producing a soft magnetic material consisting essentially of up to 0.05% carbon, up to 1.0% manganese, up to 0.5% sulfur, up to 0.5% silicon, from 0.5 to 1.5% phosphorus, balance iron and residuals. The method comprises the steps of: blending iron powder and phosphorus-bearing powder into a mixture containing from 0.5 to 1.5% phosphorus; pressing the blended mixture; and sintering the mixture in a non-oxidizing atmosphere at a temperature and for a period of time sufficient to produce a density of at least 7 grams per cubic centimeter. The sintering temperature is at least 2200° F. The soft magnetic material is characterized by a magnetizing force to reach 10 kilogauss of no more than 2.0 oersteds, and a coercive force from 10 kilogauss of no more than 0.9 oersted.

4 Claims, No Drawings

PROCESS FOR PRODUCING PHOSPHOROUS-BEARING SOFT MAGNETIC MATERIAL

This application is a division of application Ser. No. 571,169, filed Apr. 24, 1975, now U.S. Pat. No. 4,047,983 issued Sept. 13, 1977, which is a continuation-in-part of now abandoned application Ser. No. 417,682, filed Nov. 20, 1973, which in turn is a continuation of now abandoned application Ser. No. 238,516, filed Mar. 27, 1972.

The present invention relates to a process for producing a soft magnetic material.

Most soft magnetic parts such as relay frames, armatures and cores have been manufactured from laminations or machined bar stock. In order to minimize machining, it is often advantageous to make the parts by pressing powder into a mold and sintering the pressed part. In the past, it has been common to form sintered soft magnetic parts from essentially pure iron powder containing very small amounts of carbon and other impurities.

The present invention provides a process for producing a sintered soft magnetic material which is magnetically superior to the essentially pure iron powder employed heretofore. The material is a phosphorus-bearing iron substance containing from 0.5 to 1.5% phosphorus, and having a density of at least 7 grams per cubic centimeter. Its production involves the blending of iron powder and phosphorus-bearing powder, pressing, and sintering at a temperature in excess of 2200° F.

A number of patents and articles described sintered phosphorus-bearing iron alloys. These references include U.S. Pat. Nos. 2,226,520; 3,497,347; and 3,836,355; East German Pat. No. 20,635; and an article on page 12737 in Volume 63 Chemical Abstracts, 1965 (19-Ferrous Metals and Alloys), entitled, "Investigations of Phosphorus-Alloyed Iron Powders". None of them do, however, disclose the subject invention. Not one of them is at all concerned with magnetic materials. Moreover, not one of them disclose a process wherein iron powder and phosphorus-bearing powder are blended, pressed and sintered at a temperature in excess of 2200° F., in order to produce a phosphorus-bearing soft magnetic material having from 0.5 to 1.5% phosphorus and a density of at least 7 grams per cubic centimeter.

It is accordingly an object of this invention to provide a process for producing a sintered soft magnetic material from iron powder and phosphorus-bearing powder.

As stated hereinabove, the present invention provides a process for producing a superior sintered soft magnetic material. The material is a phosphorus-bearing iron substance containing from 0.5 to 1.5% phosphorus, and having a density of at least 7 grams per cubic centimeter and preferably from 7.15 to 7.35 grams per cubic centimeter. More specifically, the material is one which consists essentially of up to 0.05% carbon, up to 1.0% manganese, up to 0.05% sulfur, up to 0.5% silicon, from 0.5 to 1.5% phosphorus, balance iron and residuals. Said material is characterized by a magnetizing force to reach 10 kilogauss of no more than 2.0 oersteds, and preferably no more than 1.75 oersteds, and a coercive force from 10 kilogauss of no more than 0.9 oersted and preferably no more than 0.8 oersted.

Processing for the present invention, comprises the steps of: blending iron powder and phosphorus-bearing powder into a mixture containing from 0.5 to 1.5% phosphorus; pressing said blended mixture; and sintering said mixture in a non-oxidizing atmosphere at a temperature and for a period of time sufficient to produce a density of at least 7 grams per cubic centimeter. The minimum sintering temperature is 2200° F. Sintering temperatures of at least 2250° F. are preferred. The magnetic properties of the material are dependent upon both its density and sintering temperature. Sintering times cannot be precisely set forth as they are dependent on various factors such as sintering temperature and load size. Pressing of the blended mixture is generally, but not necessarily, performed at pressures of from 20 to 60 tons per square inch. Processing can involve more than one pressing and sintering. The final sintering is, however, always carried out at a temperature of at least 2200° F. Exemplary phosphorus-bearing powders are ferro phosphorus, red phosphorus and iron phosphate. Ferro-phosphorus with about 22 to 30% phosphorus is preferred. For lubrication during compaction, stearic acid and/or other lubricants can be admixed with the blend.

The following examples are illustrative of several embodiments of the invention.

EXAMPLE I

Low carbon (0.022%) iron powder was blended with ferrophosphorus powder having an average phosphorus content of 26.03%, and 0.5% of a lubricant to produce a powder blend having an overall phosphorus content of 0.8%. The blended powder was subsequently compacted into rings with respective nominal outside and inside dimensions of 3.75 and 2.56 centimeters. The weight of the rings was varied to obtain thicknesses of about 0.7 centimeter at initial sintering densities of approximately 6.4, 6.8, 7.0, 7.2 and 7.4 grams per cubic centimeter. Initial sintering was at a temperature of 2050° F. for one hour in a dry hydrogen atmosphere. Magnetic testing of the rings was carried out after the initial sintering and again after subsequent sinterings. Subsequent sinterings were also for one hour in a dry hydrogen atmosphere. Temperatures for the subsequent sinterings were 2150° and 2250° F.

The results of the magnetic testing appear hereinbelow in Table I. Listed therein are the maximum magnetizing force to reach an induction of 10 kilogauss and the coercive force (the force required to bring the residual induction down to zero). Both the magnetizing force and the coercive force are given for the five initial densities (the densities achieved with a 2050° F. sinter), and for the corresponding five densities after sinters at 2150° and 2250° F.

TABLE I

| Density (g/cu cm) | | | Maximum Magnetizing Force for 10 KB | Coercive Force From an Induction |
|---|---|---|---|---|
| Sintered at 2050° F. | Resintered at 2150° F. | Resintered at 2250° F. | Induction (oersteds) | of 10 KB (oersteds) |
| 6.44 | | | 17 | 1.20 |
| | 6.77 | | 3.30 | 0.89 |
| | | 7.07 | 1.46 | 0.68 |
| 6.81 | | | 4.3 | 1.13 |
| | 7.02 | | 2.20 | 0.82 |
| | | 7.23 | 1.24 | 0.62 |
| 7.09 | | | 3.1 | 1.08 |
| | 7.23 | | 2.17 | 0.83 |
| | | 7.40 | 1.25 | 0.64 |
| 7.31 | | | 2.7 | 1.08 |
| | 7.42 | | 2.10 | 0.86 |
| | | 7.53 | 1.51 | 0.70 |
| 7.40 | | | 2.4 | 1.12 |

TABLE I-continued

| Density (g/cu cm) | | | Maximum Magnetizing Force for 10 KB Induction (oersteds) | Coercive Force From an Induction of 10 KB (oersteds) |
|---|---|---|---|---|
| Sintered at 2050° F. | Resintered at 2150° F. | Resintered at 2250° F. | | |
| | 7.49 | | 2.20 | 0.90 |
| | | 7.56 | 1.57 | 0.72 |

From Table I it is noted that all five of the rings sintered at 2250° F. had a magnetizing force of less than 1.75 oersteds and a coercive force of less than 0.8 oersted. Also notable is the fact that none of the samples sintered at 2050° and 2150° F. had a magnetizing force as low as 2.0 oersteds nor a coercive force as low as 0.8 oersted. As for density, the best properties were achieved when the density was 7.23 grams per cubic centimeter. Densities of from 7.15 to 7.35 are, as stated hereinabove, preferred. Moreover, densities of 7.23 and 7.40 produced better magnetic properties when they were achieved with a 2250° F. sinter than did respective densities of 7.23 and 7.42 when they were achieved with a 2150° F. sinter. Higher sintering temperatures could possibly increase purification and/or diffusion of phosphorus. Magnetic properties for the soft magnetic material being produced are dependent on both density and sintering temperature.

EXAMPLE II

Two additional rings (Rings A and B) were prepared from the same iron powder and ferro-phosphorus powder as that used in Example I. Compaction and sintering were also the same as with Example I. The weight of the rings was adjusted to obtain a thickness of about 0.7 at an initial sintering density of approximately 7.2. Ring A had an overall phosphorus content of 0.4% instead of 0.8% as in Example I. Ring B had a phosphorus content of 0.5%. The soft magnetic material produced by the subject invention has a phosphorus content of from 0.5 to 1.5. The magnetic testing results for Rings A and B appear hereinbelow in Table II.

TABLE II

| Ring | Density (g/cu cm) | | | Maximum Magnetizing Force For 10 KB Induction (oersteds) | Coercive Force From an Induction Of 10 KB (oersteds) |
|---|---|---|---|---|---|
| | at 2050° F. | Resintered at 2150° F. | Resintered at 2250° F. | | |
| A (0.4% P) | 7.17 | | | 3.9 | 1.38 |
| | | 7.20 | | 3.6 | 1.29 |
| | | | 7.38 | 2.65 | 0.97 |
| B (0.5% P) | 7.26 | | | 3.3 | 1.20 |
| | | 7.37 | | 2.7 | 1.05 |
| | | | 7.47 | 2.0 | 0.78 |

From Table II it is noted that the magnetic properties of Ring B were superior to those of Ring A. Significantly, Ring B had 0.5% phosphorus whereas Ring A had only 0.4% phosphorus. When Ring B was sintered at 2250° F. It had a magnetizing force of 2.0 oersteds and a coercive force of 0.78 oersted.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A process for producing a phosphorus containing iron soft magnetic material consisting essentially of iron, up to 0.05% carbon, up to 1.0% manganese, up to 0.05% sulfur, up to 0.5% silicon, and from 0.5 to 1.5% phosphorus, which comprises the steps of: blending iron powder and ferro phosphorus powder containing from 22 to 30% phosphorus into a mixture containing from 0.5 to 1.5% phosphorus; pressing said blended mixture; and sintering said mixture in a non-oxidizing atmosphere at a temperature and for a period of time sufficient to produce a density of at least 7 grams per cubic centimeter, said sintering temperature being at least 2200° F.; said soft magnetic material being characterized by a magnetizing force to reach 10 kilogauss of no more than 2.0 oersteds, and a coercive force from 10 kilogauss of no more than 0.9 oersted.

2. A process according to claim 1, wherein said sintering temperature is at least 2250° F.

3. A process according to claim 1, wherein said soft magnetic material is characterized by a magnetizing force to reach 10 kilogauss of no more than 1.75 oersteds, and a coercive force from 10 kiloguass of no more than 0.8 oersteds.

4. A process according to claim 1, wherein said mixture is sintered at a temperature and for a period of time sufficient to produce a density of from 7.15 to 7.35 grams per cubic centimeter.

* * * * *